US008857173B2

(12) United States Patent
Beale

(10) Patent No.: US 8,857,173 B2
(45) Date of Patent: Oct. 14, 2014

(54) TWO PISTON, CONCENTRIC CYLINDER, ALPHA FREE PISTON STIRLING MACHINE

(75) Inventor: William T. Beale, Athens, OH (US)

(73) Assignee: Sunpower, Inc., Athens, OH (US)

( * ) Notice: Subject to any disclaimer, the term of this patent is extended or adjusted under 35 U.S.C. 154(b) by 344 days.

(21) Appl. No.: 13/478,275

(22) Filed: May 23, 2012

(65) Prior Publication Data

US 2013/0180239 A1 Jul. 18, 2013

Related U.S. Application Data

(60) Provisional application No. 61/586,250, filed on Jan. 13, 2012, provisional application No. 61/609,433, filed on Mar. 12, 2012.

(51) Int. Cl.
*F02G 1/04* (2006.01)

(52) U.S. Cl.
USPC ..... 60/520; 60/526; 60/525

(58) Field of Classification Search
CPC ..... F25B 9/14; F25B 9/145; F25B 2309/001; F02G 1/0435; F02G 1/043
USPC ..... 60/516–526
See application file for complete search history.

(56) References Cited

U.S. PATENT DOCUMENTS

2008/0295511 A1* 12/2008 Beale ..... 60/520

* cited by examiner

*Primary Examiner* — Thomas Denion
*Assistant Examiner* — Kelsey Stanek
(74) *Attorney, Agent, or Firm* — Frank H. Foster; Kremblas & Foster

(57) ABSTRACT

A two piston, free piston, alpha Stirling cycle machine has a compression piston with a cylindrical bore that is coaxial with the cylinders in which the pistons reciprocate. An expansion piston sealingly extends into both an expansion cylinder and into the cylindrical bore in the compression piston. The expansion piston has the same diameter within both the expansion cylinder and the cylindrical bore. A spring, preferably a gas spring, drivingly connects the pistons. The reciprocation of the expansion piston varies only the volume of the expansion space and the reciprocation of the compression piston varies only the volume of the compression space. The spring that drivingly connects the pistons allows the two pistons to be properly phased without a mechanical linkage so that they can operate in a thermodynamically effective phase over a range of strokes.

14 Claims, 6 Drawing Sheets

Fig 1 Prior Art
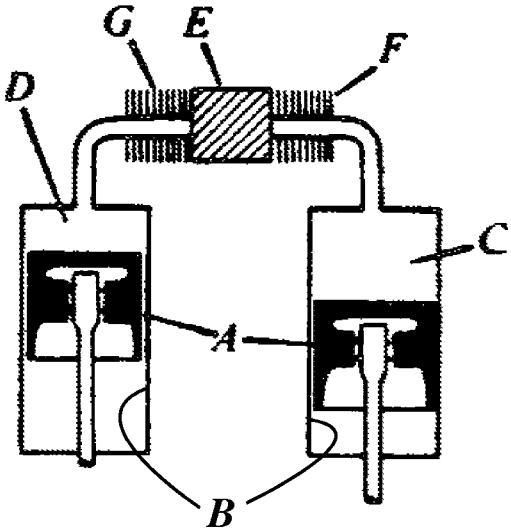
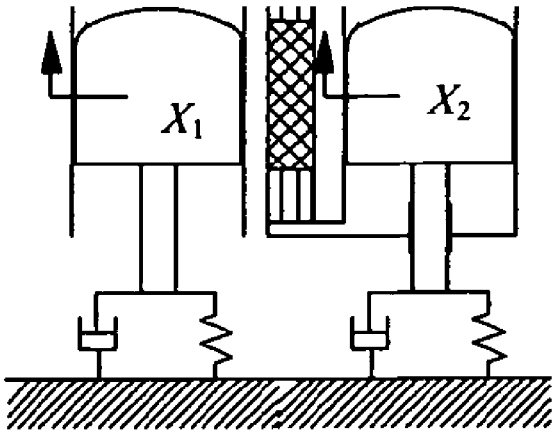
Fig 2 Prior Art

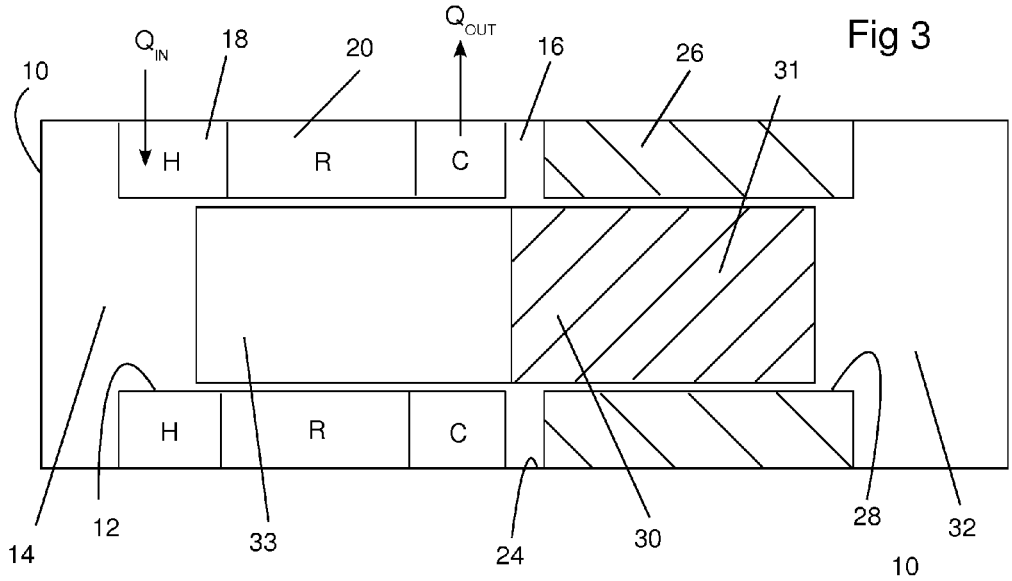
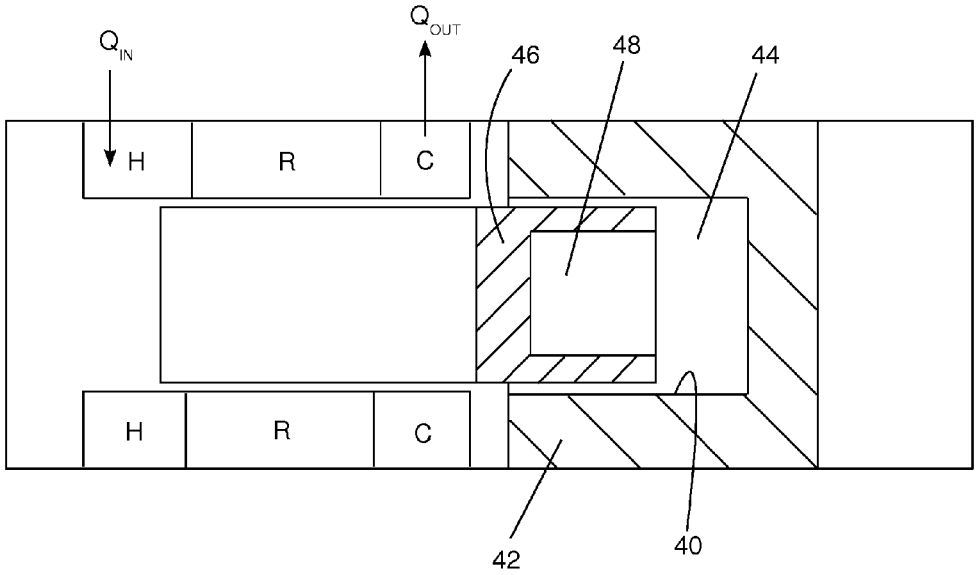
Fig 4

Fig 5
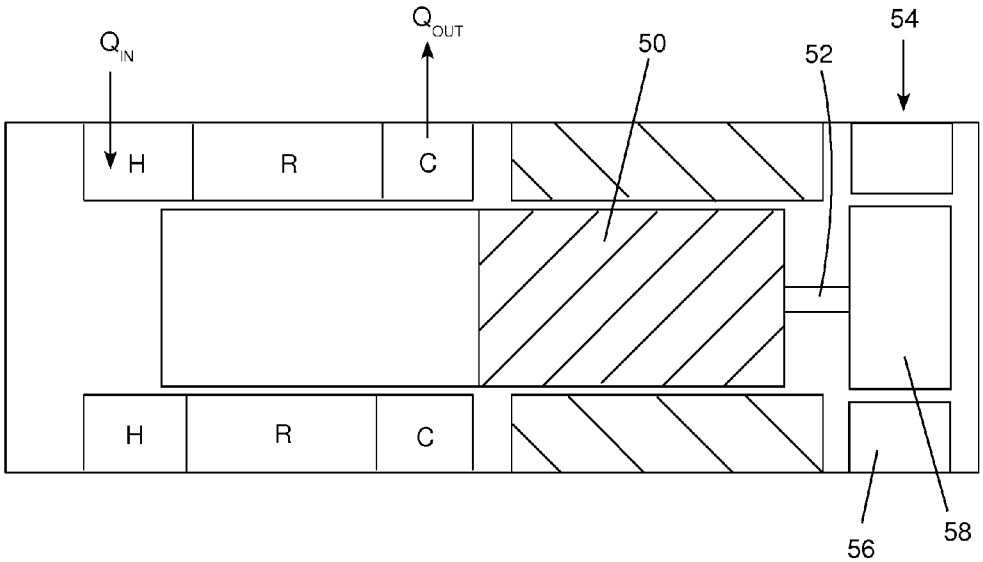
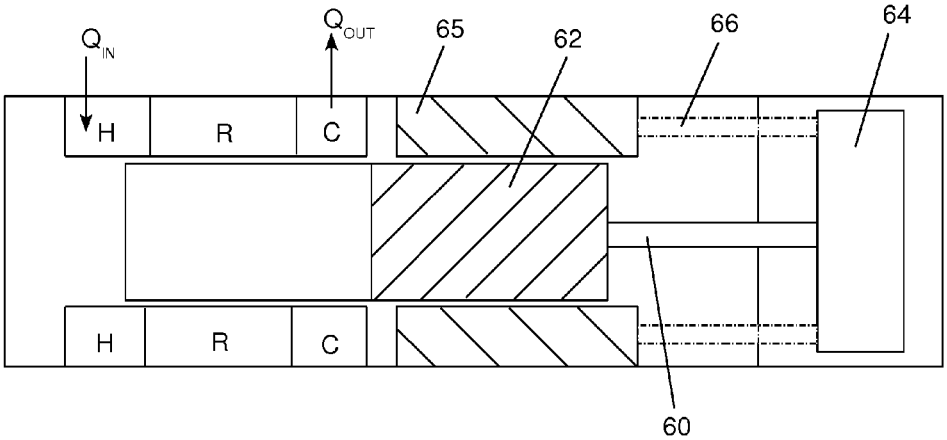
Fig 6

Fig 7
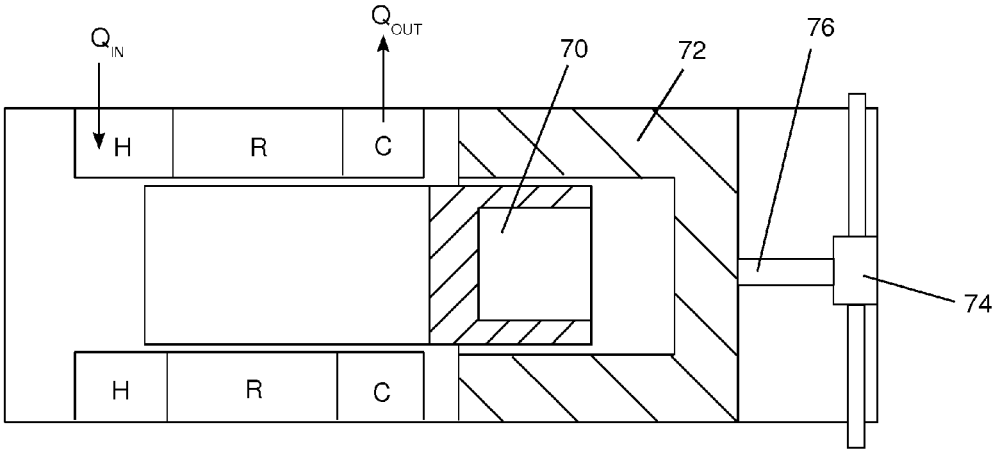
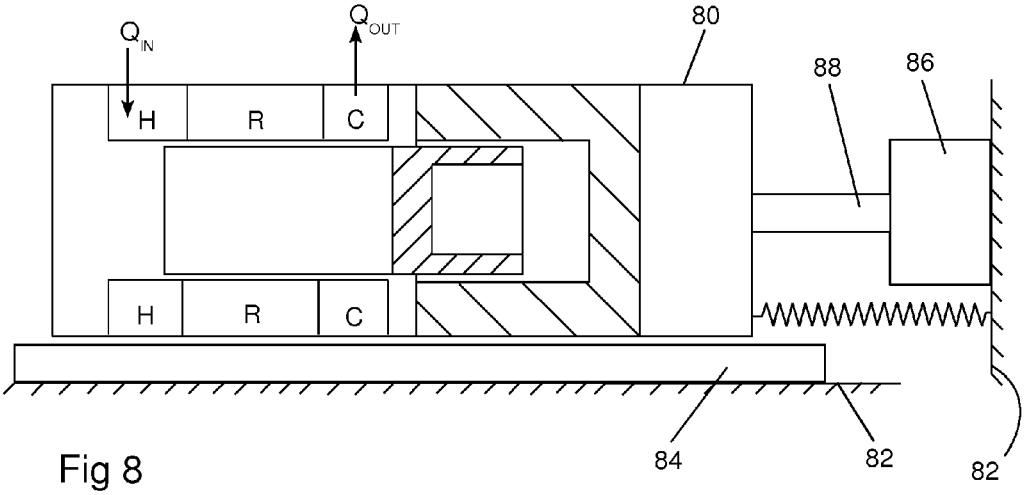
Fig 8

TWO PISTON, CONCENTRIC CYLINDER, ALPHA FREE PISTON STIRLING MACHINE

CROSS-REFERENCES TO RELATED APPLICATIONS

This application claims the benefit of U.S. Provisional Application Nos. 61/586250filed Jan. 13, 2012 and 61/609,433 filed Mar. 12, 2012.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

This invention relates generally to free piston Stirling cycle engines, heat pumps and coolers and more particularly relates to a free piston alpha type of Stirling machine that, although it has two pistons, is configured so that it can be operated with a phase angle between the pistons that provides thermodynamically efficient operation without a mechanical drive linkage between the two pistons. The principal advantage of the invention is that it can be manufactured at a substantially reduced cost because it allows wider concentricity and alignment tolerances than physically comparable Stirling machines.

As well known in the art, in a Stirling machine a working gas is confined in a working space that includes an expansion space and a compression space. The working gas is alternately expanded and compressed in order to either do mechanical work or to pump heat from the expansion space to the compression space. The working gas is cyclically shuttled between the compression space and the expansion space as a result of the motion of one or more power pistons and, in some machines a displacer piston. Historically the pistons were mechanically linked together by a drive mechanism, such as a crank, that rigidly confines the reciprocating pistons to a fixed phase relationship and a fixed stroke. Later Stirling machines have pistons that are "free" because their phase and stroke is not fixed by a mechanical linkage but instead the pistons are linked by forces applied by internal gases and springs and therefore their stroke can vary under different operating conditions. The compression space and the expansion space are connected in fluid communication through a heat accepter, a regenerator and a heat rejecter, the heat acceptor and heat rejector being heat exchangers. The shuttling of the working gas cyclically changes the relative proportion of working gas in each space. Gas that is in the expansion space, and gas that is flowing into the expansion space through a heat exchanger (the accepter) between the regenerator and the expansion space, accepts heat from surrounding surfaces. Gas that is in the compression space, and gas that is flowing into the compression space through a heat exchanger (the rejecter) between the regenerator and the compression space, rejects heat to surrounding surfaces. The gas pressure is essentially the same in the entire work space at any instant of time because the expansion and compression spaces are interconnected through a path having a relatively low flow resistance. However, the pressure of the working gas in the work space as a whole varies cyclically and periodically. When more of the working gas is in the compression space, heat is rejected from the gas. When more of the working gas is in the expansion space, the gas accepts heat. This is true whether the machine is working as a heat pump or as an engine. The only requirement to differentiate between work produced or heat pumped, is the temperature at which the expansion process is carried out. If this expansion process temperature is higher than the temperature of the compression space, then the machine is inclined to produce mechanical work so it can function as an engine. If this expansion process temperature is lower than the compression space temperature and the Stirling machine is driven by a prime mover, then the machine will pump heat from a cold source to a warmer heat sink.

In a Stirling engine the expansion space is often referred to as the hot space and the compression space as the cold space because the expansion space is at a higher temperature than the compression space. In a Stirling machine that is mechanically driven to pump heat, the temperature relationship of those two spaces is the opposite. Similarly, a piston that has an end face as a boundary of the expansion space is often called the hot piston in an engine and is the colder piston in a Stirling machine operating in a heat pumping mode. The opposite terminology is used for the pistons when operating in the two possible different modes. To avoid the confusion caused by naming the pistons after their relative temperatures, more consistent terminology is to use the term "expansion piston" for a piston that bounds an expansion space and the term "compression piston" for a piston that bounds a compressions space.

A Stirling machine that pumps heat is sometimes referred to as a cooler when its purpose is to cool a mass and is sometimes referred to as a heat pump when its purpose is to heat a mass. The Stirling heat pump and the Stirling cooler are fundamentally the same machine to which different terminology is applied. Both transfer heat energy from one mass to another. Consequently, the terms cooler/heat pump, cooler and heat pump can be used equivalently when applied to fundamental machines. Because a Stirling machine can be either an engine (prime mover) or a cooler/heat pump, the term Stirling "machine" is used generically to include both Stirling engines and Stirling coolers/heat pumps. They are basically the same power transducers capable of transducing power in either direction between two types of power, mechanical and thermal.

Stirling machines have long been categorized into three distinct types of configurations. They are the alpha, the beta and the gamma.

An alpha Stirling machine has two separate power pistons, one is an expansion piston (hot piston in an engine) and the other is a compression piston (cold piston in an engine). In previously known alpha Stirling machines, these pistons and their associated expansion and compression spaces are located in two different and separated cylinders. FIG. 1 is a diagrammatic illustration of the earlier alpha configuration in which two single acting pistons A reciprocate in cylinders B which contain their respective compression and expansion spaces C and D. The machine is single acting because only one end face of each piston interfaces the working gas. The compression and expansion spaces C and D are connected to each other through a heat accepting heat exchanger G that transfers heat from an external source into the working gas passing through it, a regenerator E, and a heat rejecting heat exchanger F that transfers heat from working gas passing through it to an external sink. A characteristic of the single acting alpha configuration is that the reciprocation of each of its pistons varies the volume of only its associated space. The expansion piston varies only the volume of the expansion space and the compression piston varies only the volume of the compression space. In the historically earlier alpha machines, the piston rods of the two pistons were linked together by a mechanical drive mechanism, such as a crank mechanism, that constrained the reciprocation of the pistons to a desired relative phase so that the working gas in and between the compression and expansion spaces would go through a thermodynamic cycle that permitted the machine to operate and do so efficiently. However, these mechanical drive mechanisms also permitted the pistons to reciprocate at a single, fixed stroke length.

FIG. 2 illustrates two pistons and cylinders of a free piston, alpha Stirling machine configuration that is well known in the art. Such Stirling machines having three or more pistons and cylinders have been described in the prior art. The pistons are double acting because one end face of each piston varies the volume of the expansion space in its cylinder and the opposite end face varies the volume of the compression space at the opposite end of its cylinder. As known in the art, the relative phase of the pistons must be 360° divided by the number of pistons. Consequently, if an alpha machine is constructed from the components illustrated in FIG. 2 and has only two pistons, the pistons would be phased 180° apart. However, 180° degree phasing of the pistons is thermodynamically inoperable. Insofar as known, the current technology does not describe a two piston, free piston alpha Stirling machine.

The second recognized Stirling machine configuration is the beta Stirling machine. The beta configuration has a single power piston arranged coaxially with a displacer piston. The displacer piston does not extract any power from or contribute any power to the working gas but only serves to shuttle the working gas between the expansion and compression space through the heat exchangers and regenerator.

The third recognized Stirling machine configuration is the gamma Stirling machine. It is much like a beta Stirling machine except the power piston is not mounted coaxially to its displacer piston. This configuration produces a lower compression ratio but is often mechanically simpler and often used in multi-cylinder Stirling engines.

Each of these Stirling machine configurations has its own set of advantages and disadvantages relative to the others. The alpha configuration is an assembly of relatively simple pistons in cylinders and requires relatively simple, and therefore relatively inexpensive, machining of its cylinders and pistons. However, the alpha configuration has multiple cylinders and it is impractical to house the multiple cylinders of an alpha machine in a single casing. Because it has multiple cylinders, the alpha configuration is not as compact as the beta configuration and also requires a surrounding assembly of a regenerator and associated heat exchangers for each of its multiple cylinders. Additionally, so far as known, a free piston, two piston alpha Stirling machine has not previously been possible.

The beta configuration is more compact and can be housed in a single casing because it has a single cylinder or two end to end adjacent, axially aligned, cylinders. The beta configuration has only one surrounding assembly of a regenerator and heat exchangers. A load (such as an alternator) or a prime mover (such as an electromagnetic linear motor) is easily connected to the single power piston of a beta configuration and can be housed in the same casing. Unfortunately, the beta configuration also has critical, small tolerance alignment and concentricity requirements in order to avoid problems of sealing the displacer's connecting rod to the piston, and rubbing of the displacer piston on the walls of its cylinder. Meeting these requirements and avoiding the problems requires higher precision machining which translates into higher costs of manufacture. The beta configuration ordinarily requires a relatively stiff spring for efficient operation but such a spring adds cost and a significant risk of failure from fatigue.

Although the advantages of the invention can be appreciated only after the invention is explained, it is an object and purpose of the invention to provide in one Stirling machine many of the desirable characteristics of the different Stirling machine configurations without many of the undesirable characteristics.

The principal object and feature of the invention is to provide a Stirling machine configuration that has performance characteristics comparable to existing Stirling machines but has a reduced manufacturing cost because it has reduced concentricity and alignment requirements.

Another object and feature of the invention is to provide a two piston, free piston, Stirling machine in an alpha configuration that is capable of being operated with the pistons reciprocating at a thermodynamically desirable phase relationship.

Yet another object and feature of the invention is to provide such a two piston, free piston alpha Stirling machine in which the phase relationship can be selectively tuned by the designer over a broad range of phase angles.

BRIEF SUMMARY OF THE INVENTION

The Stirling cycle machine has a first cylinder with an expansion space at one end and a compression space at its opposite end. The first cylinder is conventionally surrounded by an expansion space heat exchanger, a regenerator and a compression space heat exchanger in series fluid connection between the expansion space and the compression space. A second cylinder is coaxially aligned with the first cylinder and adjacent the compression space. A compression piston in the second cylinder has a cylindrical bore that opens toward the first cylinder and is coaxial with the cylinders. An expansion piston sealingly extends into both the first cylinder and into the cylindrical bore in the compression piston. Importantly, the expansion piston has the same diameter within both the first cylinder and the cylindrical bore. A spring connects the compression piston to the expansion piston.

The reciprocation of the expansion piston varies only the volume of the expansion space and the reciprocation of the compression piston varies only the volume of the compression space. The spring that drivingly connects the pistons allows the two pistons to be properly phased without a fixed stroke mechanical linkage so that the pistons can operate in a thermodynamically effective phase over a range of strokes. This arrangement allows the Stirling machine to be manufactured at less cost than other forms of Stirling machines with comparable output power as an engine or comparable heat pumping power as a cooler/heat pump.

BRIEF DESCRIPTION OF THE SEVERAL VIEWS OF THE DRAWINGS

FIG. 1 is a diagrammatic view of an earlier alpha Stirling machine known in the prior art.

FIG. 2 is a diagrammatic view of earlier free piston, alpha Stirling machine components known in the prior art.

FIG. 3 is a diagrammatic view of an embodiment of the invention.

FIG. 4 is a diagrammatic view of an alternative embodiment of the invention.

FIG. 5 is a diagrammatic view of an embodiment of the invention showing one manner of connecting a load to an embodiment.

FIG. 6 is a diagrammatic view of an embodiment of the invention showing another manner of connecting a load to an embodiment.

FIG. 7 is a diagrammatic view of another embodiment of the invention showing yet another manner of connecting a load to an embodiment.

FIG. 8 is a diagrammatic view of an embodiment of the invention showing a free casing manner of connecting a load to an embodiment.

Figure 9:
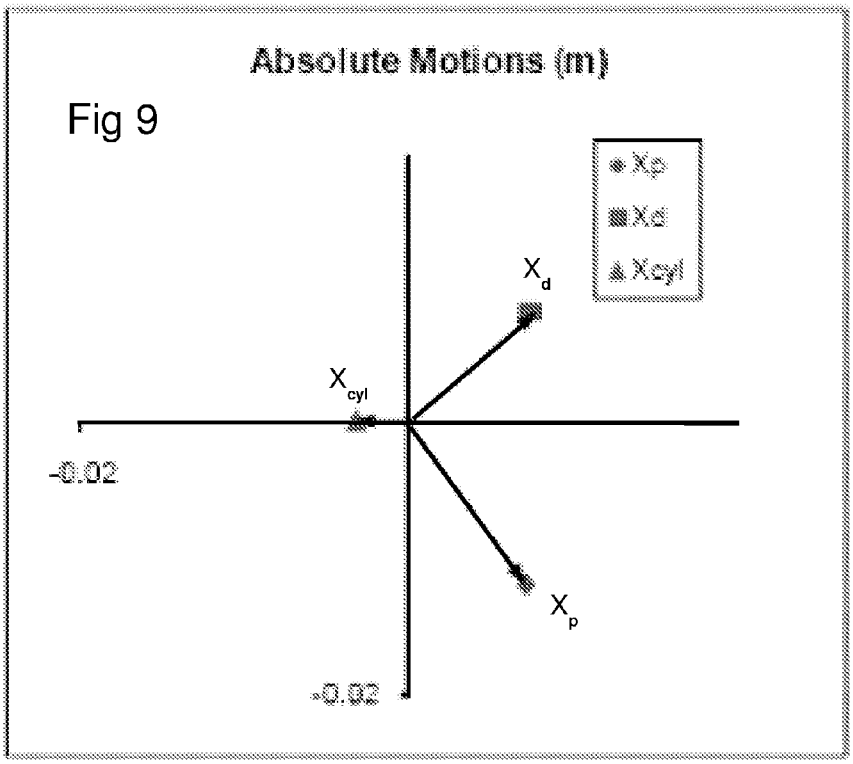
FIG. 9 is a phasor diagram showing the absolute motions of the pistons and casing of an embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

The figures are simplified diagrammatic views in order to illustrate the principles of the invention. Component parts are shown symbolically or schematically in the manner common in the art. Piston clearances are exaggerated in order to distinguish the closely fitting components. In several of the views the connection of the pistons to a prime mover or load are not illustrated because many such connections are known in the art and may be used with embodiments of the invention.

FIG. 3 illustrates a free piston, alpha, two piston, concentric cylinder, Stirling cycle machine having a casing 10 confining a working gas. A first cylinder 12 (which may also be called the expansion cylinder) has an expansion space 14 that opens into one end of the first cylinder 12 and a compression space 16 at the opposite end of the first cylinder 12. The first cylinder 12 is surrounded, in a manner that is well known in the free piston Stirling machine art, by an expansion space heat exchanger 18, a regenerator 20 and a compression space heat exchanger 22 which are in series fluid connection between the expansion space 14 and the compression space 16.

A second cylinder 24 (which may also be called the compression cylinder) is coaxially aligned with the first cylinder 12 and is adjacent the compression space 16. A compression piston 26 is sealingly reciprocatable in the second cylinder 24 and has a cylindrical bore 28 opening toward the first cylinder 12 and coaxial with the cylinders 12 and 24.

An expansion piston 30 sealingly extends into both the first cylinder 12 and the cylindrical bore 28, the expansion piston having the same diameter within both the first cylinder 12 and the cylindrical bore 28. The expansion piston 30 may comprise two portions, a high mass portion 31 and a relatively hollow portion 33. The relatively hollow portion 33 has a high volume to mass ratio and may be designed in the manner of a displacer piston in order to minimize the transfer of heat by conduction through the portion of the expansion piston 30 that extends through the first cylinder 12 within the regenerator and into the expansion space.

In embodiments of the invention, a spring connects the compression piston 26 to the expansion piston 30 so that power can be coupled between the pistons through the spring. Because the spring is not a rigid connection, the pistons 26 and 30 can reciprocate with respect to each other at varying strokes. This spring allows the Stirling machine to be tuned so that the phase relationship between the reciprocation of the compression piston 26 and the reciprocation of the expansion piston 30 can be selected by the designer using traditional design procedures known in the mechanical engineering field.

The spring in the embodiment of FIG. 3 is a gas spring comprising the gas that is in the volume of a back space 32. The cylindrical bore 28 in the compression piston 26 extends entirely through the compression piston 26 and opens into a back space 32. Therefore, the gas in the back space 32 applies a spring force on the end faces of both pistons 26 and 30 that interface with the back space 32.

FIG. 4 illustrates another embodiment of the invention. In the embodiment of FIG. 4, the casing, cylinders, heat exchanger, regenerator, expansion space and compression space are the same as shown in the embodiment of FIG. 3 and therefore are not separately described or indicated by reference numerals. However the pistons in the embodiment of FIG. 4 and the spring coupling them are different. In the embodiment of FIG. 4, the cylindrical bore 40 in the compression piston 42 extends only partially into but not entirely through the compression piston 42. Consequently, there is a confined gas spring space 44 within the compression piston 42 that operates as a gas spring. As the expansion piston 46 reciprocates axially with respect to the compression piston 42, the volume of the gas spring space 44 varies so that the gas in the gas spring space 44 is resiliently compressed and expanded to provide a gas spring that drivingly links the pistons 42 and 46. The gas spring space 44 may be enlarged by forming a cavity 48 in the expansion piston 46.

As a result of the fact that, in both of these embodiments, the part of the expansion (first) cylinder in which the expansion piston reciprocates, the expansion piston, and the cylindrical bore in the compression piston all have the same diameter, reciprocation of the two pistons only varies the volume of its associated part of the working space. Translation of the expansion piston varies only the volume of the expansion space and does not vary the annular volume of the compression space. Similarly, translation of the compression piston varies only the annular volume of the compression space and does not vary the volume of the expansion space. That is a characteristic of single acting alpha Stirling machines. The diameters of the expansion piston and the compression piston and their consequent end face areas and the ratio of their end face areas are variables that can be chosen by the designer.

A Stirling machine embodying the invention can, like all Stirling machines, be operated as an engine with its power applied from either or both pistons through a drive linkage to a load or alternatively either or both pistons can be driven through a drive linkage by a prime mover so that the machine pumps heat from its expansion space to its compression space. The prior art shows numerous such load, prime mover and drive linkage arrangements that are applicable to embodiments of the invention. For example, as illustrated in FIG. 5, a piston 50 can be drivingly connected through a connecting rod 52 to a linear alternator or linear motor 54 that is contained within the casing. A typical arrangement would have an armature winding 56 surrounding reciprocatable magnets 58.

As illustrated in FIG. 6, a connecting rod 60 can be connected between an expansion piston 62 and a prime mover or load 64, such as a water or hydraulic pump. Alternatively, one or more connecting rods 66 may be connected from a compression piston 65 to the prime mover or load 64. As a further alternative, both pistons can be connected to a load or prime mover.

As illustrated in FIG. 7, for embodiments that have the gas spring space 70 formed within the compression piston 72, the compression piston 72 can be directly linked to a load 74, such as a water pump, by a connecting rod 76.

Another manner of drivingly connecting an embodiment of the invention to a load or prime mover is a free casing system that is illustrated in FIG. 8. The casing 80 is mounted with freedom to reciprocate axially with respect to ground 82. For example the casing 80 can be mounted to a track 84 or other bearing that permits linear reciprocation in the axial direction. The casing 80 is connected to a load or prime mover 86 by a connecting rod 88. The casing 80 reciprocates axially as a result of the periodic acceleration and deceleration of the pistons and the consequent periodic gas pressure variations applied to the internal surfaces of the casing 80. In order to permit proper tuning of the entire system, a spring 90 is connected between the casing 80 and the ground 82.

In the previous descriptions, there has been reference to springs and particularly to gas springs. The invention is not limited to gas springs because many of the various types of springs that are known in the prior art may be substituted for the illustrated and described springs. For example, referring to FIG. 3, the expansion piston 30 can be drivingly connected to the compression piston 26 through a planar spring located in the back space 32. Such a planar spring would have its periphery connected to the compression piston 26 and its center connected to the expansion piston 30, preferably by a connecting rod to avoid collision of the expansion piston with the radially outer parts of the planar spring. With the pistons connected by a mechanical spring, the back space is not necessarily a gas spring and therefore can have a larger volume with only minimal periodic pressure variation. Of course both gas and other springs can be used in combination. However, gas springs are preferred because mechanical springs are subject to fatigue and breakage, introduce side forces, and can add unnecessary costs.

A feature that is believed to be a novel characteristic of the present invention is that, although it is a single acting, free piston, alpha Stirling machine, it can be tuned to a desired phase angle between the pistons without the need for a mechanical drive mechanism that interconnects the two pistons and requires that they reciprocate at a single fixed stroke that is predetermined by the drive mechanism. The reason that a machine embodying the invention can be designed to have a chosen phase angle is that the two pistons are drivingly linked together by a spring. The desired phase angle is a function of the spring constant of that spring, the mass of the components, the gas pressure, damping and physical dimensions and any other variables that designers of free piston Stirling machines have been analyzing for several decades. Designing the Stirling machine to have the desired phase angle is a routine mechanical engineering design problem. All the forces acting upon the bodies are summed using Newton's laws of motion to determine the spring constants, masses and other parameters for a particular design.

Figure 10:
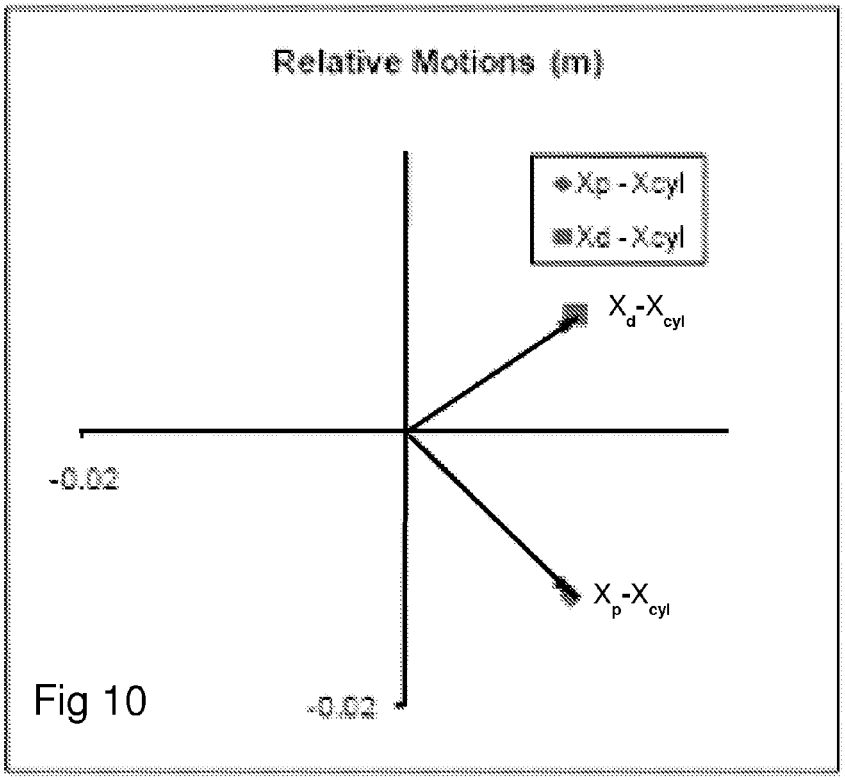
FIG. 10 is a phasor diagram showing the relative motions of the pistons and casing of an embodiment of the invention and also illustrating the absolute motions on another embodiment of the invention.

FIG. 9 illustrates the desirable phasing of a free casing embodiment of the invention such as illustrated in FIG. 8. The phasors of FIG. 9 represent axial translation $X_{CYL}$ of the casing and cylinders fixed to the interior of the casing, axial translation $X_p$ of the compression piston and axial translation of the expansion piston $X_d$. The translation variables are "absolute" because they are all represent motion with respect to ground. FIG. 10 illustrates the axial translation $X_p$ of the compression piston and the axial translation $X_d$ of the expansion piston both with respect to the casing. Consequently the FIG. 10 phasors also represent the absolute motion of the pistons with respect to ground for an embodiment that is not a free casing configuration because it has the casing fixed to ground. An important observation is the essentially 90° phase lag of the compression piston translation phasor $X_p$ behind the expansion piston translation phasor $X_d$. Generally for most Stirling engine applications, it is desirable for the expansion piston to lead the compression piston by about or a little less than 90°, although the invention is not limited to a narrow range of phase angles.

Figure 11:
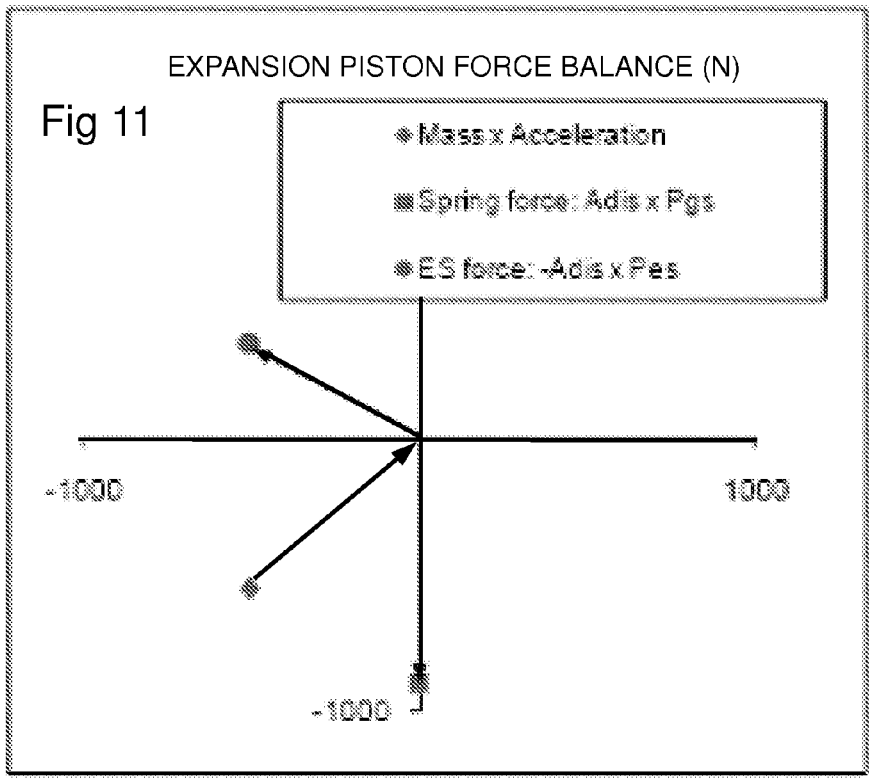
FIG. 11 is a phasor diagram illustrating the expansion piston force balance of an embodiment of the invention.
Figure 12:
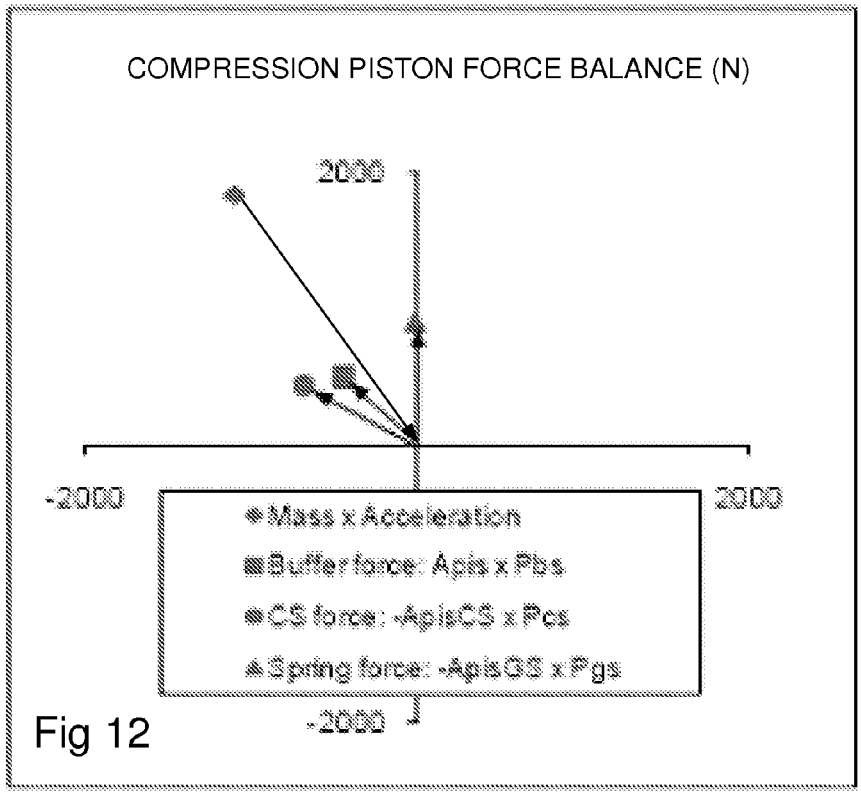
FIG. 12 is a phasor diagram illustrating the compression piston force balance of an embodiment of the invention.

FIGS. 11 and 12 illustrate the summed forces for the expansion piston and the compression piston respectively for the same embodiment as FIGS. 9 and 10. The key to the illustrated parameters is:

$A_{dis}$=the end face area of the expansions piston;

$A_{pis}$=the compression piston end face area that faces the back space;

$A_{pisCS}$=the compression piston end face area that faces the compression space;

$A_{pisGS}$=the compression piston area that is acted upon by the gas spring gas;

$P_{gs}$=the pressure of the gas in the gas spring that links the two pistons;

$P_{es}$=the pressure of the gas in the expansion space;

$P_{bs}$=the pressure of the gas in the back space (a.k.a. bounce space, buffer space);

$P_{cs}$=the pressure of the gas in the expansion space;

ES force=the force applied by the expansion space on the expansion piston;

Buffer force=the force applied by the back space on the compression piston

CS force=the force applied by the compression space on the compression piston;

Spring force=the force applied to the pistons by the gas spring;

Previous two piston, free piston alpha Stirling machines required the pistons to operate at phases that are 360° divided by the number of pistons and therefore an alpha Stirling machine with two free pistons was not possible. However, with the present invention, because the two free pistons are connected through a spring, an alpha machine with two free pistons can be designed to maintain a phase angle between the pistons that is desirable for a particular application of a Stirling machine. Rather than using a displacer for the mechanical transfer of PV power from expansion space to compression space as done in a beta configuration, this design provides for indirect transfer via gas-spring coupling between the two pistons.

One of the most significant advantages of the present invention is that implementations of the invention obtain a thermodynamic performance that is comparable to a beta Stirling machine and, like a beta machine, are compact and can contain all machine components in a single casing but the cost of manufacture of such implementations is less because their alignment and concentricity requirements are less critical. In a beta Stirling machine, the displacer has two cylindrical component parts, the displacer piston and a connecting rod. The diameter of the connecting rod is much smaller than the diameter of the displacer piston for thermodynamic reasons. The displacer piston and the displacer rod must be rigidly and coaxially joined together because these cylindrical displacer parts reciprocate in two different but sealingly mating cylindrical openings. In order to provide a good seal that minimizes gas leakage between their interfacing cylindrical walls, the parts are manufactured to have a small clearance. However, the small clearance requires more expensive precision machining within narrow tolerances. Then these two close fitting but reciprocating cylindrical components must also be precisely coaxially aligned so that they are concentric. Because they reciprocate as a rigidly connected unit within two different cylindrical openings, any misalignment displacer and its rod results in rubbing or binding. So the beta Stirling machine requires not only the cost of precision machining in order to maintain small clearance seals, but also requires time consuming and costly alignment procedures. Additionally, the relatively small diameter displacer rod does not make a very good mechanical guide for a large diameter displacer piston.

With the present invention, there is no piston that has a small diameter rod extending axially from it. Instead, the expansion piston of the present invention has a large and preferably uniform diameter along its entire length, although axially short circumferential grooves could be machined into the expansion piston without changing these advantageous characteristics. So the invention eliminates the need for an alignment procedure to align two components.

Another advantage of the invention is that embodiments of the invention do not have the connector tube conductance losses of the standard alpha configuration. Unlike other alpha configurations, the expansion piston can have the relatively hollow portion 33 described above in connection with FIG. 3. That reduces the heat transfer by conduction through the expansion piston which represents a loss of engine efficiency by conduction of heat that is therefore not used to perform work that translates into engine power. Similarly, such conduction represents a loss of heat pumping power in a cooler/heat pump.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A free piston, alpha, two piston, concentric cylinder, Stirling cycle machine having a casing confining a working gas and comprising within the casing:

(a) a first cylinder having an expansion space opening into one end of the first cylinder and a compression space opening at the opposite end of the first cylinder, the first cylinder surrounded by an expansion space heat exchanger, a regenerator and a compression space heat exchanger in series fluid connection between the expansion space and the compression space;

(b) a second cylinder coaxially aligned with the first cylinder and adjacent the compression space;

(c) a compression piston sealingly reciprocatable in the second cylinder and having a cylindrical bore opening toward the first cylinder and coaxial with the cylinders;

(d) an expansion piston sealingly extending into both the first cylinder and the cylindrical bore, the expansion piston having the same diameter within both the first cylinder and the cylindrical bore; and (e) a spring connecting the compression piston to the expansion piston.

2. A Stirling machine in accordance with claim 1 wherein the spring is a gas spring.

3. A Stirling machine in accordance with claim 2 wherein the cylindrical bore extends only partially into but not entirely through the compression piston and the gas spring is a gas volume within the compression piston.

4. A Stirling machine in accordance with claim 2 wherein the cylindrical bore extends through the compression piston to a back space which forms the gas spring applying a spring force on the ends of both pistons.

5. A Stirling machine in accordance with claim 4 wherein a load is mechanically linked to one of the pistons for operating the Stirling machine as a Stirling engine driving the load.

6. A Stirling machine in accordance with claim 5 wherein the load is mechanically linked to the expansion piston.

7. A Stirling machine in accordance with claim 4 wherein the casing is mounted to a support with freedom to reciprocate in an axial direction and is connected by a spring to a load for driving the load in reciprocation through the spring.

8. A Stirling machine in accordance with claim 4 wherein a reciprocating prime mover is mechanically linked to one of the pistons for driving the Stirling machine as a heat pumping machine.

9. A Stirling machine in accordance with claim 8 wherein the prime mover is mechanically linked to the expansion piston.

10. A Stirling machine in accordance with claim 3 wherein a load is mechanically linked to one of the pistons for operating the Stirling machine as a Stirling engine driving the load.

11. A Stirling machine in accordance with claim 9 wherein a load is mechanically linked to the expansion piston.

12. A Stirling machine in accordance with claim 3 wherein the casing is mounted to a support with freedom to reciprocate in an axial direction and is connected by a spring to a load for driving the load in reciprocation through the spring.

13. A Stirling machine in accordance with claim 3 wherein a reciprocating prime mover is mechanically linked to one of the pistons for driving the Stirling machine as a heat pumping machine.

14. A Stirling machine in accordance with claim 12 wherein the prime mover is mechanically linked to the expansion piston.

* * * * *